US011022011B2

(12) United States Patent
Lechartier et al.

(10) Patent No.: US 11,022,011 B2
(45) Date of Patent: Jun. 1, 2021

(54) OIL PAN

(71) Applicant: NOVARES France, Clamart (FR)

(72) Inventors: Mickaël Lechartier, Avion (FR); Jean-Claude Quevallier, Lesquin (FR); Jérôme Demangeot, Calonne sur la Lys (FR)

(73) Assignee: NOVARES FRANCE, Clamart (FR)

( * ) Notice: Subject to any disclaimer, the term of this patent is extended or adjusted under 35 U.S.C. 154(b) by 111 days.

(21) Appl. No.: 16/342,759

(22) PCT Filed: Oct. 12, 2017

(86) PCT No.: PCT/FR2017/052816

§ 371 (c)(1),
(2) Date: Apr. 17, 2019

(87) PCT Pub. No.: WO2018/073513

PCT Pub. Date: Apr. 26, 2018

(65) Prior Publication Data

US 2019/0264589 A1 Aug. 29, 2019

(30) Foreign Application Priority Data

Oct. 18, 2016 (FR) ..... 16/60104

(51) Int. Cl.
*F01M 11/00* (2006.01)
*F01M 5/00* (2006.01)
*F01M 5/02* (2006.01)

(52) U.S. Cl.
CPC ..... *F01M 11/0004* (2013.01); *F01M 5/007* (2013.01); *F01M 5/02* (2013.01);
(Continued)

(58) Field of Classification Search
CPC ..... F01M 11/0004; F01M 5/02; F01M 5/007; F01M 5/021; F01M 2005/023;
(Continued)

(56) References Cited

U.S. PATENT DOCUMENTS 3,100,028 A * 8/1963 Booth ..... F01M 11/0004 184/106
5,038,890 A * 8/1991 Tanaka ..... F01M 11/0004 184/6.5

(Continued)

FOREIGN PATENT DOCUMENTS

CN 101133234 A 2/2008
CN 102207013 A 10/2011

(Continued)

OTHER PUBLICATIONS

English Machine Translation to Abstract of JP2011231662.

(Continued)

*Primary Examiner* — Hung Q Nguyen
(74) *Attorney, Agent, or Firm* — Cantor Colburn LLP

(57) ABSTRACT

The invention relates to an oil sump (1) comprising a lower shell (2) intended for containing lubricating oil of an engine, in which a flow of oil, referred to as suction oil flow (I), is sucked up via a suction tube (44) to supply a lubricating circuit, and an oil flow, referred to as returning oil flow (II), falls into the oil sump (1). The oil sump (1) comprises an anti-emulsion plate (8) arranged located at the mouth of the suction tube (44) during a transitional period in which the temperature of the oil is lower than an optimal operating temperature.

18 Claims, 4 Drawing Sheets

(52) U.S. Cl.
CPC ..... *F01M 5/021* (2013.01); *F01M 2005/023* (2013.01); *F01M 2011/005* (2013.01); *F01M 2011/007* (2013.01); *F01M 2011/0033* (2013.01); *F01M 2011/0045* (2013.01)

(58) Field of Classification Search
CPC ... F01M 2011/0033; F01M 2011/0045; F01M 2011/005; F01M 2011/007
See application file for complete search history.

(56) References Cited

U.S. PATENT DOCUMENTS

| | | | | | |
|---|---|---|---|---|---|
| 5,456,227 | A * | 10/1995 | Shimmell | F01M 11/0004 | 123/195 H |
| 7,341,039 | B1 * | 3/2008 | Jaszewski | F01M 11/0004 | 123/195 AC |
| 7,516,728 | B1 * | 4/2009 | Staley | F01M 11/0004 | 123/195 C |
| 8,302,577 | B2 * | 11/2012 | Wunsch | F01M 11/0004 | 123/196 R |
| 10,344,639 | B1 * | 7/2019 | Nickols | F02F 7/0043 | |
| 2005/0279316 | A1 * | 12/2005 | Rice | F01M 11/0004 | 123/195 C |
| 2007/0221447 | A1 * | 9/2007 | Bicker | F01M 11/0004 | 184/106 |
| 2009/0145695 | A1 | 6/2009 | Hiramatsu | | |
| 2013/0312696 | A1 * | 11/2013 | Mordukhovich | F01M 11/0004 | 123/196 AB |
| 2015/0300220 | A1 * | 10/2015 | Mordukhovich | F16H 57/0452 | 184/106 |

FOREIGN PATENT DOCUMENTS

| | | | | | |
|---|---|---|---|---|---|
| CN | 204457921 | A | | 7/2015 | |
| DE | 2852854 | A1 | | 6/1980 | |
| DE | 199 12 327 | A1 | | 9/2000 | |
| DE | 102012020282 | A1 | * | 4/2014 | F01M 11/0004 |
| DE | 102016216359 | A1 | * | 3/2018 | F01M 11/00 |
| EP | 1640572 | A2 | * | 3/2006 | F01M 5/02 |
| GB | 2305467 | A | * | 4/1997 | F01M 5/007 |
| JP | 55054618 | A | * | 4/1980 | F01M 5/001 |
| JP | 57024409 | A | * | 2/1982 | |
| JP | 2011231662 | A | | 11/2011 | |
| JP | 2013113229 | A | * | 6/2013 | F01M 11/0004 |
| JP | 2013113229 | A | | 6/2013 | |
| JP | 2014139423 | A | | 7/2014 | |

OTHER PUBLICATIONS

English Machine Translation to Abstract of JP2014139423.
International Search Report for Application No. PCT/FR2017/052816.
Written Opinion for Application No. PCT/FR2017/052816.
English Translation to First Office Action for Application No. 2017800644778.
First Office Action for Application No. 2017800644778.
First Search Report for Application No. 2017800644778; dated Apr. 18, 2019.
Annex to the communication for Application No. 17 794 377.6; dated Nov. 3, 2020.

* cited by examiner

OIL PAN

CROSS REFERENCE TO RELATED APPLICATIONS

This application is a National Stage of PCT Application No. PCT/FR2017/052816 filed on Oct. 12, 2017, which claims priority to French Patent Application No. 16/60104 filed on Oct. 18, 2016, the contents each of which are incorporated herein by reference thereto.

TECHNICAL FIELD

The present invention concerns an oil pan intended to be fixed under the engine block of an internal combustion engine.

BACKGROUND

The main function of an oil pan is to contain the oil needed to lubricate an engine and to dissipate some of the heat generated by the engine.

Conventionally, an oil pan includes a shell which is fixed under the engine block.

During operation, the oil present in the pan is sucked by an oil pump and is propelled to the various engine members to be lubricated (for example, camshafts, valve stems, crankshaft bearings, piston/cylinder, piston/connecting rod, crankshaft/connecting rod interfaces, etc.), then the oil returns to the pan by natural run-off or channelized return depending on the case.

The pan receives in its interior volume a strainer allowing to stop solid materials such as filings produced by the engine members contained in the oil before reaching the suction orifice of the pump, and a plate called anti-emulsion plate, whose role is to prevent or limit the movements of the oil in the pan, particularly at the free surface of the oil.

During its path, the oil is heated by the engine parts and cooled in the oil pan.

When starting the engine, the engine members are at ambient temperature. During the transitional phase of temperature rise to the optimum operating temperature, the engine does not operate optimally and particularly the fuel consumption proves to be substantially higher; this is because the combustion does not occur at optimum temperature.

In a general issue of optimizing the operation of an engine in order to reduce its consumption, a search pathway aims at reducing the duration of the transitional startup phase so that the engine reaches its optimum operating temperature as quickly as possible.

BRIEF SUMMARY

In this context, the purpose of the present invention is to provide an oil pan which allows decreasing the heating time of the oil of the engine lubrication circuit and therefore decreasing the fuel consumption when starting the engine as well as the carbon dioxide emissions.

According to a general definition, the invention concerns an oil pan comprising a lower shell intended to contain oil for lubricating an engine block, in which an oil flow, called sucked oil flow, is sucked by a suction tube for supplying a lubrication circuit and an oil flow, called returning oil flow, falls into the oil pan. The oil pan comprises an anti-emulsion plate disposed in the oil pan and orientation means allowing to orient at least a portion of the returning oil flow to an area located at the mouthpiece of the suction tube for a transitional period during which the oil has a temperature lower than an optimum operating temperature.

Thus, the invention provides an oil pan which allows the oil flow returning to the pan (that is to say an oil flow which, when in contact with the members that it has lubricated, is at a temperature which is higher than the temperature of the oil stored in the pan which is for its part at a temperature substantially equal to the ambient temperature) to make a short path by leading the returning oil flow directly to the mouthpiece of the suction tube of the oil pump. In other words, during the startup transition phase, the oil flow returning into the pan is directly sucked by the oil pump without having dissipated the heat that it carries in the oil mass of the pan. The invention establishes a bypass of the returning oil flow in order to retain the heat contained therein and to directly use the returning oil flow to supply the lubrication circuit.

Indeed, during the transitional period, the sucked oil flow mostly comes from the oil flow returning from the lubrication circuit. When in contact with the engine parts, the returning oil flow rises in temperature. Thus, the oil flow sucked during the transitional period, mostly contains oil heated by the engine members, which accelerates the rise in temperature of the sucked oil to its optimum operating temperature. In other words, the repeated re-use, during the transitional period, of the returning oil flow as a sucked oil flow allows accelerating the temperature rise of the sucked oil by avoiding a cooling caused by the mixing of the returning oil flow with the oil stored in the lower shell. The rapid rise in temperature of the sucked oil to its optimum temperature allows decreasing the heating time of the engine lubrication circuit. Thus, the invention provides an oil pan which allows decreasing the heating time of the oil of the engine lubrication circuit. The engine more quickly reaches its optimum operating temperature and therefore allows lowering the fuel over-consumption during the engine startup phase as well as reducing carbon dioxide emissions.

The orientation means may comprise a bypass tube opening at a first end into an opening of the anti-emulsion plate and at a second end into the mouthpiece of the suction tube.

The bypass tube and the suction tube can open into a casing having an opening allowing the oil stored in the lower shell to be sucked.

The bypass tube and the suction tube may comprise a platen connecting the bypass tube and the suction tube, the plate can be adapted to be fixed to the casing.

According to a first embodiment, the orientation means may comprise a bimetal shutter positioned in the opening of the anti-emulsion plate. The bimetal shutter can be movable between an open position in which the oil can flow into the opening and a closed position in which the bimetal shutter closes off the opening. The bimetal shutter can be adapted to switch to the closed position when the oil reaches or exceeds its optimum temperature.

The anti-emulsion plate may have a series of orifices for the passage of the oil flow returning to the lower shell.

According to one embodiment, the orientation means may comprise a series of bimetal shutters each positioned on a passage orifice. The bimetal shutters are movable between a closed position in which the bimetal shutters close off the passage orifices and an open position in which the oil can flow into the passage orifices. The bimetal shutters are adapted to switch to the open position when the oil reaches or exceeds its optimum temperature.

According to another embodiment, the orientation means may comprise a grid, the grid may have a plurality of micro-perforations, the micro-perforations being configured to be traversed by the oil reaching or exceeding a determined viscosity. The rise in the oil temperature allows changing the oil viscosity.

The anti-emulsion plate may comprise a gutter in which the opening and the passage orifices are positioned.

The gutter may have a slope adapted to promote the oil flow to the opening of the anti-emulsion plate.

The anti-emulsion plate may have a curved geometry adapted to recover the oil coming from the engine block.

BRIEF DESCRIPTION OF THE DRAWINGS

Other features and advantages of the invention will emerge from the following description with reference to the appended drawings that show two embodiments of the invention.

With reference to FIG. 1, the invention concerns an oil pan 1 intended to be fixed to an engine block.

DETAILED DESCRIPTION

Figure 1:
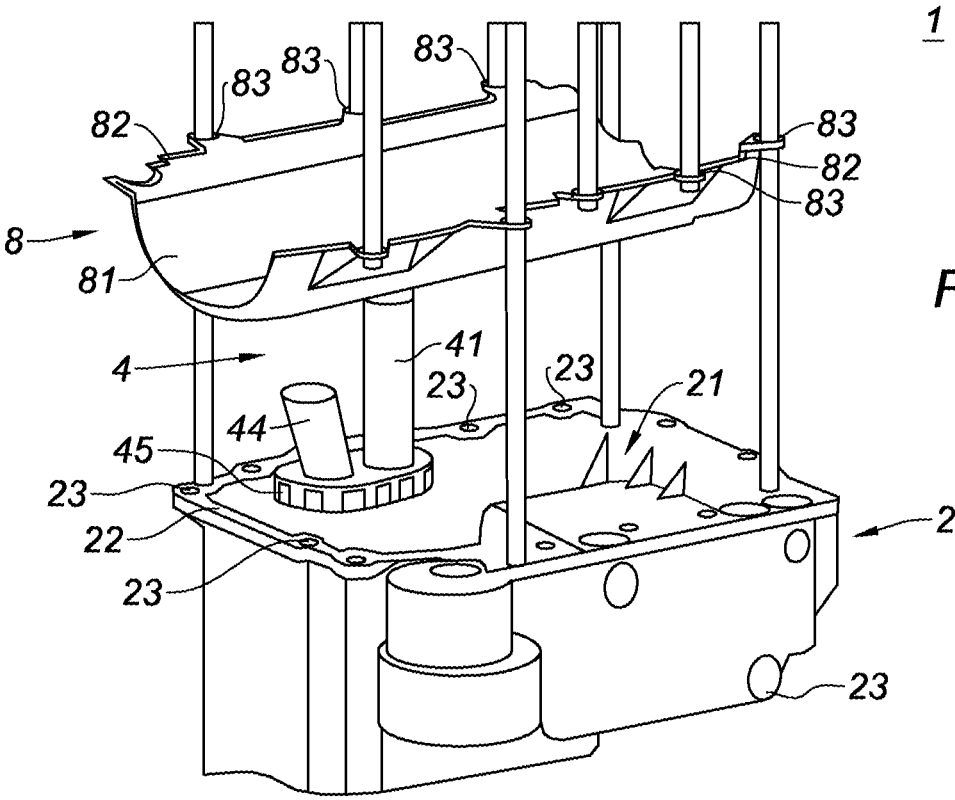
FIG. 1 is a perspective view of a pan according to the invention.

The oil pan 1 comprises in particular a lower shell 2, a suction tube 44 connected at one of its ends to an oil pump and which opens at its second end into the lower shell 2, an anti-emulsion plate 8 and orientation means which allow orienting a returning oil flow. A strainer is positioned at the mouthpiece of the suction tube 44 in order to stop solid materials such as filings produced by the engine members contained in the oil.

The lower shell 2 has a substantially parallelepiped shape with an upper opening 21. The opening 21 is surrounded by a flange 22. The flange 22 has bores 23 allowing to fix an anti-emulsion plate 8 to the lower shell 2. The bottom shell 2 is adapted to contain oil. According to the example presented here, the lower shell 2 is made of polymeric material. According to other embodiments, the lower shell 2 could, for example, be made of aluminum casting.

The anti-emulsion plate 8 is intended to cover the upper opening 21 of the lower shell 2. According to the example presented here, the anti-emulsion plate 8 is made of polymeric material. According to other embodiments, the anti-emulsion plate 8 could, for example, be made of aluminum. The anti-emulsion plate 8 has a collection segment 81. The collection segment 81 has two fixing flanges 82. Each fixing flange has bores 83 for fixing the anti-emulsion plate 8 to the lower shell 2. The fixing of the anti-emulsion plate 8 to the lower shell 2 may for example be made with bolts or rivets. The collection segment 81 has a substantially semi-cylindrical section. The collection segment 81 comprises a bottom area offset in the direction of the bottom of the lower shell 2 relative to the fixing flanges 82. The bottom area comprises a gutter 84. The gutter 84 has a bottom wall 84*a* and flanks 84*b*.

According to a first embodiment, the oil passage orifices 86 are formed in the flanks 84*b* of the gutter 84.

An opening 87 is formed in the bottom wall 84*a*. The bottom wall 84*a* is inclined on both sides of the opening 87, so that the opening 87 is at the low point of the bottom wall 84*a*.

Figure 2:
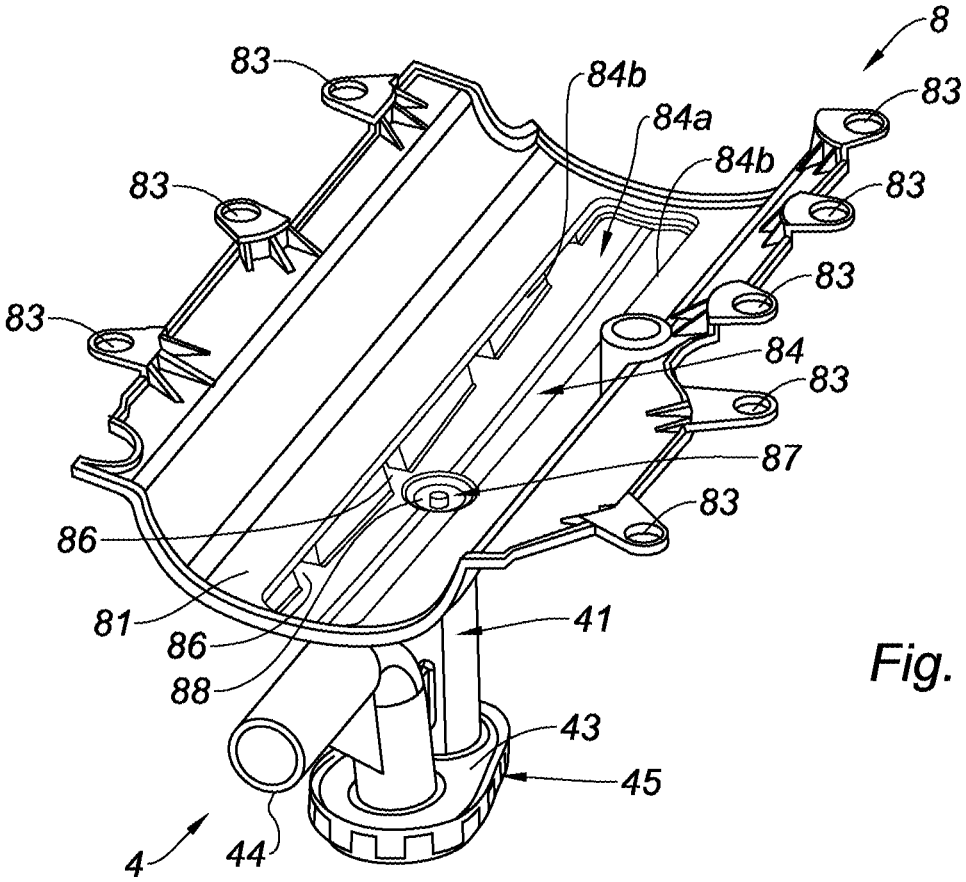
FIG. 2 is a perspective view of a first embodiment of an anti-emulsion plate connected to a bypass tube, according to the invention.

According to the first embodiment, shown in FIG. 2, the opening 87 is closed off by a bimetal shutter 88 to switch it from its passing position to its non-passing position. The bimetal shutter 88 is movable between an open position in which the opening 87 allows passage of the oil and a closed position in which the bimetal shutter 88 closes off the opening 87. The bimetal shutter 88 is configured to switch to the closed position when the oil circulating on the anti-emulsion plate 8 reaches or exceeds an optimum temperature of the engine operation which is usually comprised between 30° C. and 50° C.

Figure 3:
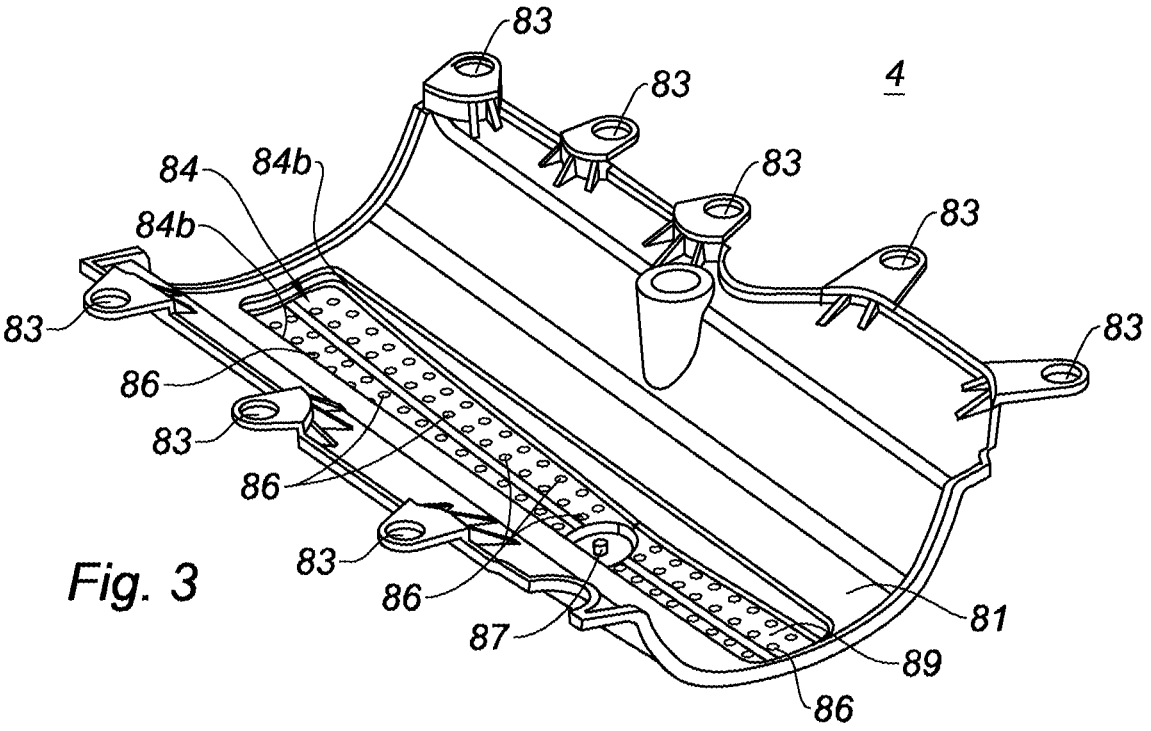
FIG. 3 is a perspective view of a second embodiment of an anti-emulsion plate according to the invention.
Figure 4:
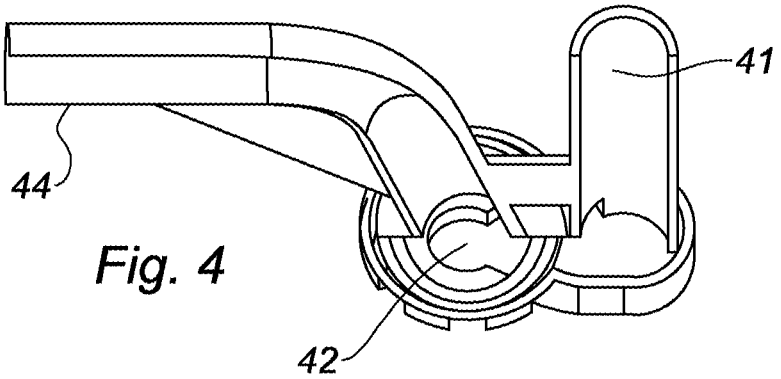
FIG. 4 is a sectional perspective view of a first embodiment of a bypass tube and a suction tube according to the invention.
Figure 5:
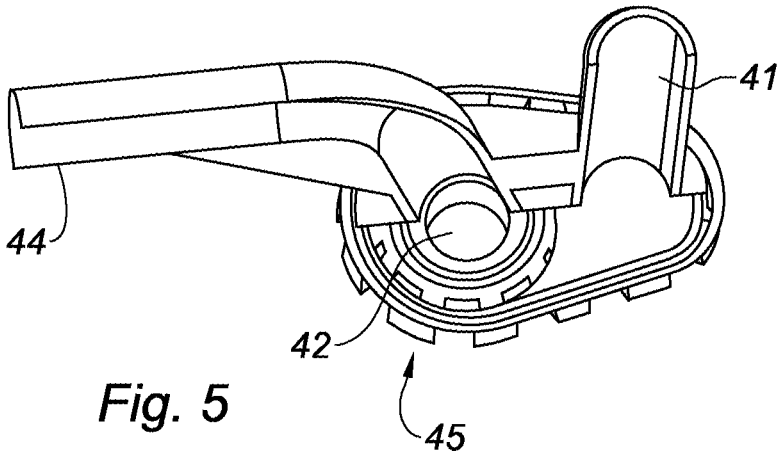
FIG. 5 is a sectional perspective view of a second embodiment of a bypass tube and a suction tube according to the invention.

According to a second embodiment, shown in FIG. 3, the gutter 84 comprises a grid 89. The grid 89 has a plurality of micro-perforations which are the passage orifices 86. The opening 87 passes through the grid 89, such that the opening 87 is not concealed by the grid 89. The micro-perforations of the grid 89 are configured to be traversed by the oil when the oil reaches or exceeds a defined viscosity associated with a defined temperature.

Figure 8:
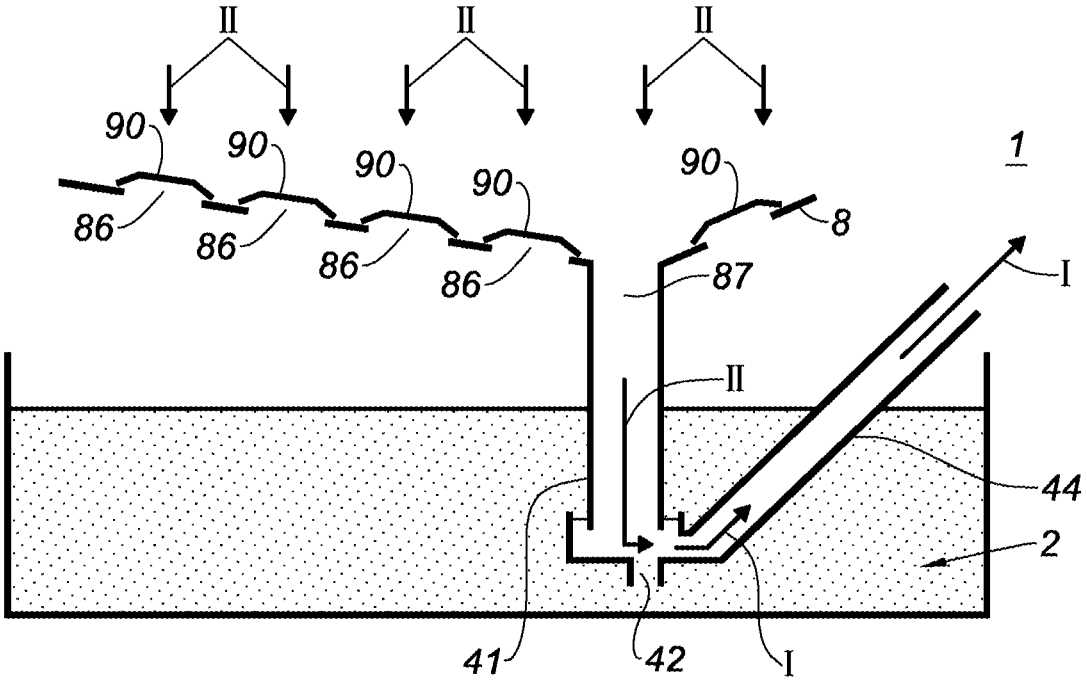
FIGS. 8 and 9 are schematic representations of the operation of a third embodiment of an oil pan according to the invention.
Figure 9:
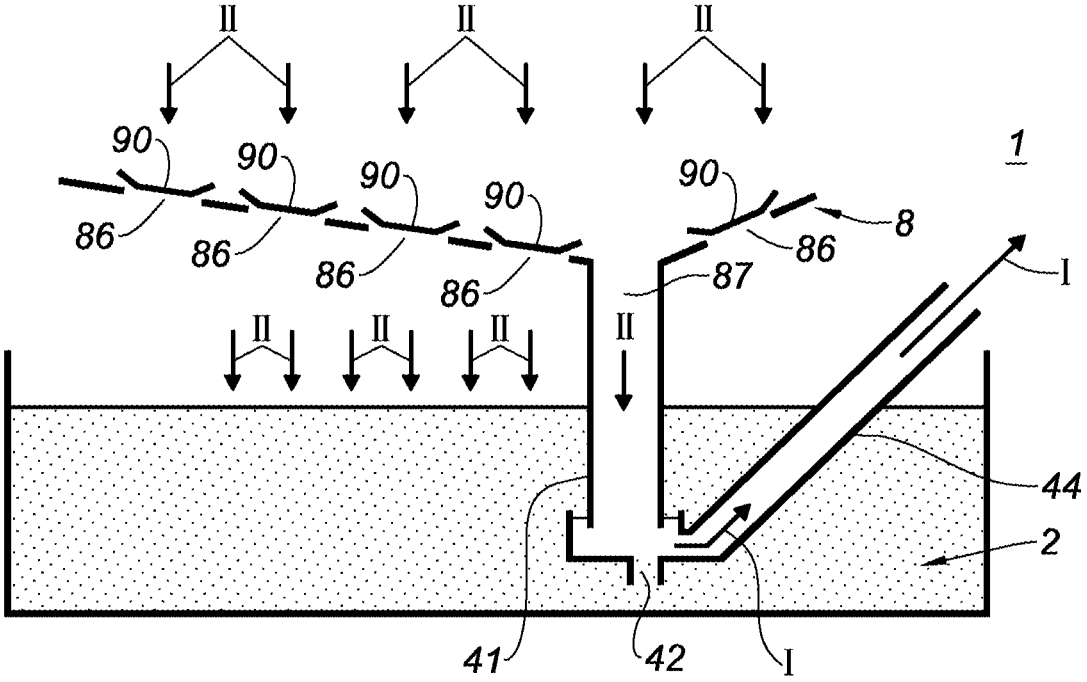

According to a third embodiment, shown in FIGS. 8 and 9, the passage orifices 86 are closed off by bimetal shutters 90. The bimetal shutters 90 are movable between a closed position in which the bimetal shutters 90 close off the passage orifices 86 and an open position in which the oil can flow into the passage orifices. The bimetal shutters 90 are adapted to switch to the open position when the oil reaches or exceeds its optimum temperature.

The orientation means comprise a bypass tube 41. The bypass tube 41 opens at a first end into the opening 87 of the anti-emulsion plate 8 and at a second end into the mouthpiece of the suction tube 44. The bypass tube 41 and the suction tube 44 open into a casing 45. The casing 45 has an opening 42 allowing the oil stored in the lower shell 2 to be sucked.

The bypass tube 41 and the suction tube 44 comprise a platen 43 which connects the bypass tube 41 and the suction tube 44. The platen is adapted to be fixed to the casing 45.

In conditions of use, when the engine is stopped, the majority of the oil is in the lower shell 2 of the oil pan 1. From the startup of the engine, a sucked oil flow I is sucked through the suction tube 44 by the oil pump. The oil circulates in the engine parts to ensure their lubrication. When returning, the returning oil flow II falls on the anti-emulsion plate 8.

Figure 6:
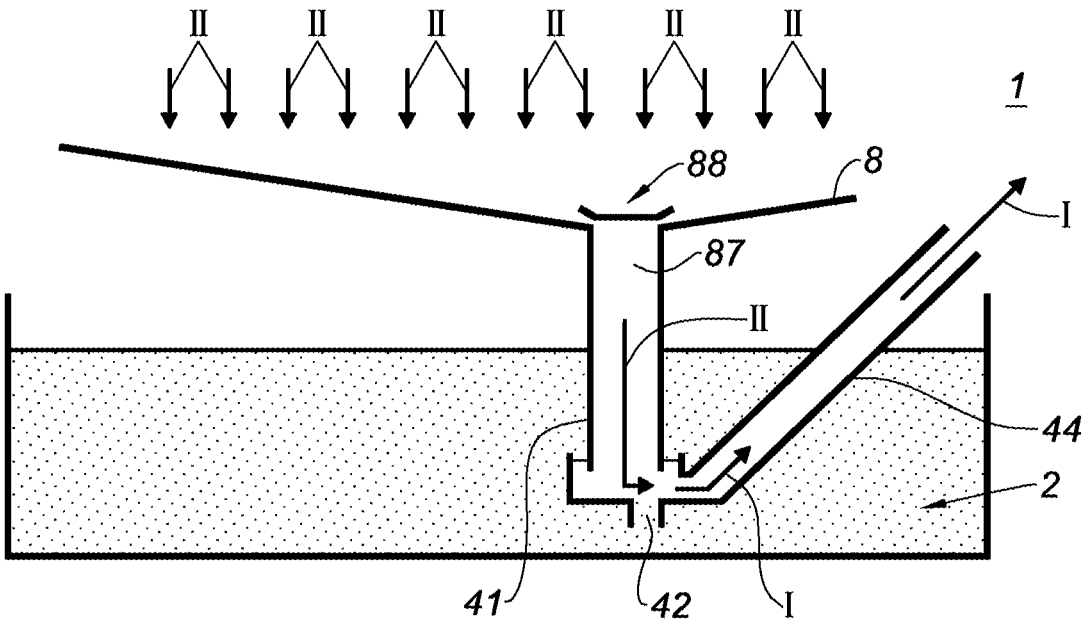
FIGS. 6 and 7 are schematic representations of the operation of an oil pan according to the invention comprising an anti-emulsion plate according to a first embodiment.
Figure 7:
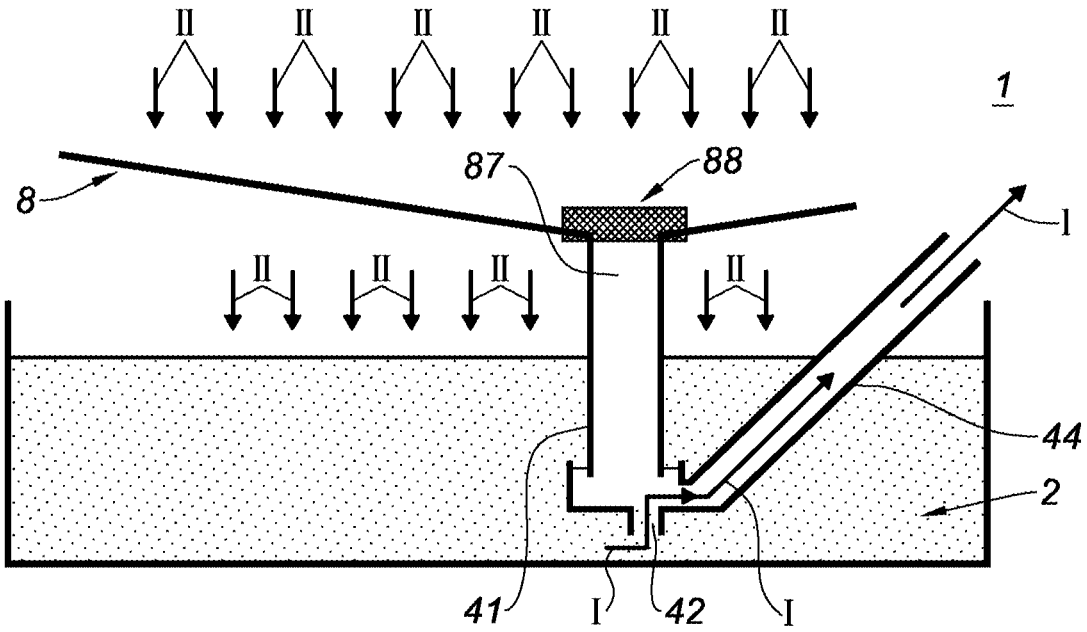

According to the first embodiment, whose operation is shown in FIGS. 6 and 7, when starting the engine, the bimetal shutter 88 is in the open position because the oil has not yet reached its optimum temperature. The returning oil flow II mostly flows through the opening 87. The inclination of the bottom wall 84*a* of the gutter 84 promotes 1*o* the oil flow to the opening 87. It is however possible that a minor amount of oil also flows through the orifices 86 and falls into the lower shell 2. The returning oil flow II which flows through the opening 87 passes through the bypass tube 41 and flows to the mouthpiece of the suction tube 44 where it is sucked and becomes the sucked oil flow I.

Thus, the sucked oil flow I which passes through the suction tube 44 mainly contains oil directly coming from the engine that has already been heated when in contact with the engine elements. When the returning oil flow II present on the anti-emulsion plate reaches or exceeds its optimum temperature, the bimetal shutter 88 switches to the closed position. In this case, all the returning oil flow flows through the orifices 86 in the lower shell 2, as shown in FIG. 7. The sucked oil flow I then comes from the lower shell 2 and passes through the opening 42 of the casing 45 in order to pass through the suction tube 44.

Thus, the first embodiment comprises active orientation means whose change of state allows the orientation of the returning oil flow II.

According to the second embodiment, the returning oil flow flows on the grid 89. As long as the returning oil flow has not reached or exceeded a defined temperature, the returning oil flow cannot pass through the grid 89. In this case, all the returning oil flow flows through the opening 87 in the bypass tube 41. When the returning oil flow reaches or exceeds a defined viscosity, the returning oil flow can pass through the grid 89 and flow through the passage orifices 86. The change in viscosity of the oil flow is caused by the change in temperature of the oil flow. The returning oil flow then flows through the passage orifices 86 and through the opening 87. The sucked oil flow I then partly comes from the lower shell 2 and passes through the opening 42 of the casing 45 in order to pass through the suction tube 44. Thus, the second embodiment comprises passive orientation means. The change of temperature and fluidity of the oil allows, or does not allow, the returning oil flow to pass through the grid 89.

It is also possible to combine the first and the second embodiment by jointly using the grid 89 and the bimetal shutter 88.

According to the third embodiment, the returning oil flow II flows on the anti-emulsion plate 8. As long as the oil has not reached its optimum temperature, the bimetal shutters 90 are in the closed position and close off the passage orifices 86. During this period, the oil therefore flows through the opening 87 in the bypass tube 41. When the returning oil flow II reaches or exceeds its optimum operating temperature, the bimetal shutters 90 switch to the open position and the oil flows through the passage orifices 86.

Thus, the third embodiment comprises active orientation means whose change of state allows the orientation of the returning oil flow II.

It is possible to combine the first and third embodiment.

Of course, the invention is in no way limited to the embodiments described above and illustrated by the various figures, these embodiments having been given only as examples. Modifications remain possible, in particular from the point of view of the substitution of technical equivalents without departing from the scope of the invention. Thus, it is possible to replace the bimetal shutters by other thermostat trigger devices of the wax capsule or shape memory alloy type.

The invention claimed is:

1. An oil pan comprising a lower shell intended to contain oil for lubricating an engine, wherein an oil flow, called sucked oil flow, is sucked by a suction tube for supplying a lubrication circuit and an oil flow, called returning oil flow, falls into the oil pan, wherein it comprises an anti-emulsion plate disposed in the oil pan and orientation means allowing to orient at least a portion of the returning oil flow to an area located at a mouthpiece of the suction tube for a transitional period during which the oil has a temperature lower than an optimum operating temperature, wherein the orientation means comprise a bypass tube opening at a first end into an opening of the anti-emulsion plate and at a second end into the mouthpiece of the suction tube, and wherein the orientation means comprise a bimetal shutter positioned in the opening of the anti-emulsion plate, the bimetal shutter being movable between an open position in which the oil can flow into the opening and a closed position in which the bimetal shutter closes off the opening, the bimetal shutter being adapted to switch to the closed position when the oil reaches or exceeds its optimum temperature.

2. The oil pan according to claim 1, wherein the bypass tube and the suction tube open into a casing having an opening allowing the oil stored in the lower shell to be sucked.

3. The oil pan according to claim 1, wherein the bypass tube and the suction tube comprise a platen connecting the bypass tube and the suction tube, the platen being adapted to be fixed to a casing.

4. The oil pan according to claim 1, wherein the anti-emulsion plate has a series of orifices for the passage of the oil flow returning to the lower shell.

5. The oil pan according to claim 4, wherein the orientation means comprise a series of bimetal shutters each positioned on each of the series of orifices, the bimetal shutters being movable between a closed position in which the bimetal shutters close off the series of orifices and an open position in which the oil can flow into the series of orifices, the bimetal shutters being adapted to switch to the open position when the oil reaches or exceeds its optimum temperature.

6. The oil pan according to claim 1, wherein the orientation means comprise a grid, the grid having a plurality of micro-perforations, the micro-perforations being configured to be traversed by the oil reaching or exceeding a determined viscosity.

7. The oil pan according to claim 1, wherein the anti-emulsion plate comprises a gutter in which the opening and a series of orifices are positioned.

8. The oil pan according to claim 7, wherein the gutter has a slope adapted to promote the oil flow to the opening of the anti-emulsion plate.

9. The oil pan according to claim 1, wherein the anti-emulsion plate has a curved geometry adapted to recover the oil coming from an engine block.

10. The oil pan according to claim 1, wherein the bypass tube and the suction tube comprise a platen connecting the bypass tube and the suction tube, the platen being adapted to be fixed to the casing.

11. The oil pan according to claim 2, wherein the bypass tube and the suction tube comprise a platen connecting the bypass tube and the suction tube, the platen being adapted to be fixed to the casing.

12. The oil pan according to claim 2, wherein the orientation means comprise a bimetal shutter positioned in the opening of the anti-emulsion plate, the bimetal shutter being movable between an open position in which the oil can flow into the opening and a closed position in which the bimetal shutter closes off the opening, the bimetal shutter being adapted to switch to the closed position when the oil reaches or exceeds its optimum temperature.

13. The oil pan according to claim 3, wherein the orientation means comprise a bimetal shutter positioned in the opening of the anti-emulsion plate, the bimetal shutter being movable between an open position in which the oil can flow into the opening and a closed position in which the bimetal shutter closes off the opening, the bimetal shutter being adapted to switch to the closed position when the oil reaches or exceeds its optimum temperature.

14. The oil pan according to claim 11, wherein the orientation means comprise a bimetal shutter positioned in the opening of the anti-emulsion plate, the bimetal shutter being movable between an open position in which the oil can flow into the opening and a closed position in which the bimetal shutter closes off the opening, the bimetal shutter being adapted to switch to the closed position when the oil reaches or exceeds its optimum temperature.

15. The oil pan according to claim 14, wherein the anti-emulsion plate has a series of orifices for the passage of the oil flow returning to the lower shell.

16. The oil pan according to claim 15, wherein the orientation means comprise a series of bimetal shutters each positioned on each of the series of orifices, the bimetal shutters being movable between a closed position in which the bimetal shutters close off the series of orifices and an open position in which the oil can flow into the series of orifices, the bimetal shutters being adapted to switch to the open position when the oil reaches or exceeds its optimum temperature.

17. The oil pan according to claim 16, wherein the orientation means comprise a grid, the grid having a plurality of micro-perforations, the micro-perforations being configured to be traversed by the oil reaching or exceeding a determined viscosity.

18. The oil pan according to claim 17, wherein the anti-emulsion plate comprises a gutter in which the opening and the series of orifices are positioned.

* * * * *